US005289606A

United States Patent [19]

Ledingham

[11] Patent Number: 5,289,606

[45] Date of Patent: Mar. 1, 1994

[54] UNITARY PAINT BRUSH AND BRISTLE HOLDER

[76] Inventor: Blake A. Ledingham, 501 - 1200 West Pender Street, Vancouver, B. C., Canada, V6E 2S9

[21] Appl. No.: 968,771

[22] Filed: Oct. 30, 1992

[51] Int. Cl.[5] ..... A46B 3/02

[52] U.S. Cl. ..... 15/168; 15/159.1; 15/193; 15/204; 15/DIG. 4

[58] Field of Search ..... 15/146, 150, 147.1, 15/159.1, 168, 169, 171, 176.5, 176.6, 177, 178, 191.1, 192, 193, 194, 202, 204, 205, DIG. 4

[56] References Cited

U.S. PATENT DOCUMENTS

| | | | |
|---|---|---|---|
| 540,824 | 6/1895 | Webb et al. | 15/178 |
| 719,227 | 1/1903 | Johnson | 15/204 |
| 871,494 | 11/1907 | Foss | 15/204 |
| 964,707 | 7/1910 | Stevens | 15/205 |
| 999,307 | 8/1911 | Holcombe | 15/178 |
| 1,198,167 | 9/1916 | Stoltz | 15/178 |
| 2,326,879 | 8/1943 | Neuhausen | 15/202 |
| 2,419,899 | 4/1947 | Kantor | 15/178 |
| 2,785,427 | 3/1957 | Bury | 15/202 |
| 2,900,654 | 8/1959 | Koltvedt | 15/176.6 |
| 2,912,709 | 11/1959 | Carlson et al. | 15/178 |
| 2,948,910 | 8/1960 | Hulla | 15/159.1 |
| 3,090,063 | 5/1963 | Weiss et al. | 15/193 |
| 3,131,419 | 5/1964 | Vosbikian et al. | 15/150 |
| 3,155,998 | 11/1964 | Hardman et al. | 15/192 |
| 3,263,259 | 8/1966 | Shulman | 15/193 |
| 4,129,918 | 12/1978 | Lee | 15/169 |
| 4,237,579 | 12/1980 | Salmon | 15/166 |
| 4,339,837 | 7/1982 | Reeberg | 15/169 |
| 4,887,327 | 12/1989 | Meimeteas | 15/168 |

FOREIGN PATENT DOCUMENTS

| | | | |
|---|---|---|---|
| 497801 | 12/1950 | Belgium . | |
| 182819 | 3/1918 | Canada | 15/146 |
| 714282 | 9/1931 | France | 15/178 |

*Primary Examiner*—Harvey C. Hornsby
*Assistant Examiner*—Mark Spisich
*Attorney, Agent, or Firm*—Klarquist Sparkman Campbell Leigh & Whinston

[57] ABSTRACT

The unitary paint brush comprises a paint brush body attached to a handle. The body defines a cavity adapted for receiving a group of bristles inserted therein. A pair of hinged releasable flaps project over the cavity to abut the bristles when moved to a closed position. The bristles are released by moving the flaps into an open position. A pair of springs are urging the flaps into the closed position.

19 Claims, 4 Drawing Sheets

UNITARY PAINT BRUSH AND BRISTLE HOLDER

FIELD OF THE INVENTION

This invention pertains to a unitary paint brush and bristle holder which can be fabricated basically as one component and can be readily cleaned after use.

BACKGROUND OF THE INVENTION

A longstanding problem with paint brushes that are used for industrial and domestic painting applications is that they are typically formed of several parts. Another longstanding problem is that, with time and repeated use, paint tends to build up within the bristles of the brush in the region where the bristles are held by the ferrule clamp that joins the bristles with the paint brush handle and base. The collected paint is difficult to clean away. Usually, some residual paint is left in the bristles even after the used brush has been cleaned. The dried paint collects and builds up over time with repeated use of the paint brush. This causes the bristles of the brush to spread and thereby reduces the efficiency of the brush. Also, the dried paint build up tends to cause the bristles to wear and break at the location of the dried paint. This reduces the life of the paint brush.

Proper cleaning of a paint brush requires a considerable amount of solvent, if the person cleaning the brush is meticulous. This constitutes a waste of costly solvent and at the same time creates an environmental pollutant. Most commercial painters will tend to minimize costs by balancing the amount of the solvent used with the number of times the paint brush is used. It may be economic, for instance, to only expect a paint brush to be used a half-dozen times before it must be discarded, rather than waste a considerable amount of solvent attempting to meticulously clean the brush after each use, and prolong the life of the paint brush.

It would be advantageous if a paint brush could be designed with a minimum of separate components. It would also be advantageous if some means could be developed which would minimize or eliminate the build up of paint in the location where the bristles are set or meet the paint brush handle. It would also be useful if a mechanism could be developed to reduce the amount of solvent which is required to clean a paint brush. It would also be beneficial if a mechanism could be developed which would reduce or eliminate bristle flare as it occurs over time when a paint brush is repeatedly used.

U.S. Pat. No. 4,129,918, granted Dec. 19, 1978, to Robert Lee, discloses an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. The sleeve does not fit over the base of the brush at the location where the bristles meet the base.

U.S. Pat. No. 4,237,579, issued Dec. 9, 1980, to Johnathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base. The tool is not designed to prevent paint from migrating down the bristles in the direction of the base.

U.S. Pat. No. 4,339,837, granted Jul. 20, 1982, to Christiaan Reeberg, discloses a sliding box-like girdle which fits over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, and thereby prevent paint from migrating along the bristles to the base, and thereby collecting at the base-bristle ended face.

SUMMARY OF THE INVENTION

The invention is directed to a unitary paint brush comprising: (a) a paint brush body and handle, the body having formed in one end thereof a cavity adapted for receiving a group of bristles; (b) a pair of hinged releasable members secured to opposite sides of the body, and projecting over the cavity, the releasable members being capable of abutting the bristles when moved to a first closed position, and being removed from the bristles when moved to a second open position; (c) movable securing means for securing the hinged releasable members in a first position and releasing the hinged releasable members for movement to a second open position; and (d) a group of bristles secured within the cavity of the holder, and between the pair of hinged releasable members.

The pair of hinged releasable members can be elongated planar flaps, and can be respectively hinged along each side to the body, adjacent the cavity. The edges of the flaps removed from the sides of the flaps that are hinged to the body can have reinforcing clips secured thereto. The movable securing means can be springs which pivot relative to the pair of flaps, and when pivoted to a first position, close the flaps against the bristles, and when pivoted to a second open position, enable the flaps to be moved away from the bristles.

A removable bristle separator can be located in the cavity between the pair of hinged releasable members. The bristles can be glued in place in the interior of the cavity by injecting glue through an opening that penetrates through the brush body into the interior of the cavity.

The removable bristle separator can be secured to the end walls of the cavity between the respective hinge releasable members and can have a series of openings along one side thereof, said openings being adapted to enable glue to pass from one side of the bristle separator to the opposite side of the bristle separator, and hold the separator in place in the interior of the cavity.

A hook can be installed in the body of the paint brush, the hook being adapted to enable the paint brush to be hooked onto a paint can. The movable securing means can be metal springs.

The hinged side flaps can have connectors which enable the side flaps to be connected with end flaps formed between the side flaps, when the side flaps are in a closed position.

DRAWINGS

In the drawings which represent a detailed illustration of specific embodiments of the invention, but which should not be construed as limiting the scope of the invention in any way:

DETAILED DESCRIPTION OF A SPECIFIC EMBODIMENT OF THE INVENTION

Unlike convention paint brushes, which typically are constructed of a wooden handle, a ferrule, a bristle separating member, nails, and bristles, the main components of the subject unitary paint brush bristle holder are formed primarily of one piece.

Figure 1:
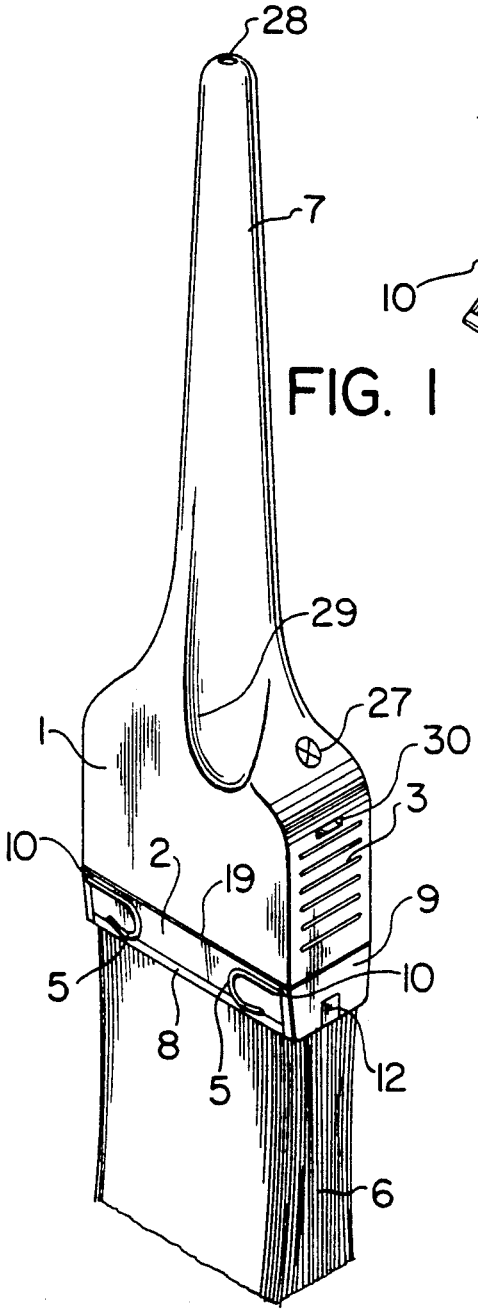
FIG. 1 illustrates an isometric view of a unitary paint brush and bristle holder.

FIG. 1 illustrates an isometric view of the unitary paint brush, handle, base and bristle holder. The main component of the unitary paint brush comprises a handle 7 which melds smoothly with the plastic body 1, which is typically formed from injection molded polypropylene or polyethylene. The body 1 has on each longitudinal side thereof, at the end opposite the handle 7, a pair of hinged bristle compressing flaps 2. Finger grips 3 are located on each narrow lateral side of the body 1. The hinged flaps 2 are held in place by rotatable springs 5 which, in a closed position, hold the flaps 2 against the bristles 6, and which, when swung to the side, release the flaps 2 so that they can be pivoted outwardly away from the bristles 6. There are two springs 5 per body 1. Each spring 5 has a U-shape, with curled ends. The hinge line for the flap 2 is indicated by hinge line 19. The free edges of the two hinged flaps 2 are reinforced with respective stainless steel U clips 8, which provide dimensional stability to the edge of the flap 2, thereby resisting bending when the flaps 2 are folded against the bristles 6. Grooves 10 are formed at each end of a flap 9. These grooves 10 accommodate the transverse part of the rotatable springs 5. End flaps 9 are located below the finger grips 3, on the narrow lateral sides opposite the handle 7.

Also seen in FIG. 1 are a breathing hole 28, at the end of the handle 7, removed from the body 1. The hole 28 permits moisture to escape from the interior of the handle 7 when the handle 7 and body 1 are being molded. An ergonomic finger groove 29 is formed in the handle 7, in the region where it meets with the body 1. This groove 29 improves grippability of the handle 7. The body 1, on the narrow lateral sides, in the region where the body 1 melds with the handle 7, includes a pair of heart valves 27. These valves are used for glue injection when the bristles 6 are being installed in the body 1.

Figure 2:
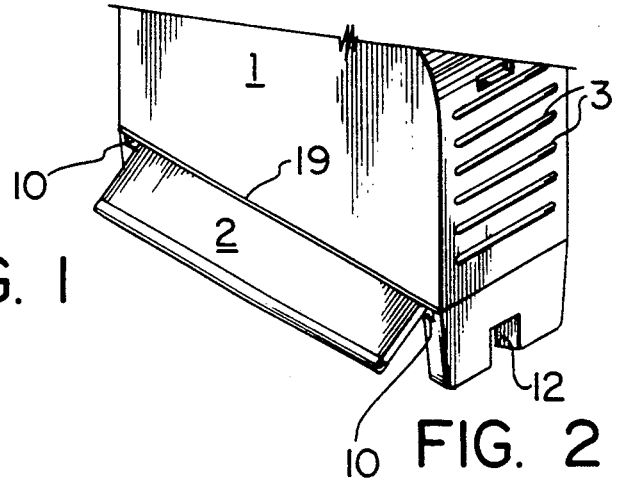
FIG. 2 illustrates a detailed isometric view of a portion of the unitary paint brush and bristle holder.

FIG. 2 illustrates an isometric side view of the body 1 and flap 2 of the unitary paint brush and bristle holder. As seen in FIG. 2, flap 2 has been pivoted upwardly away from end flap 9. The groove 10 for the lateral part of spring 5 is visible clearly in FIG. 2. The flap 2 pivots away from the end flap 9, and the bristles (not shown), along hinge line 19. Also seen in FIG. 2 is female wedge opening 12, which is adapted to receive a mid-section 11 (not shown), which will be discussed later.

Figure 3:
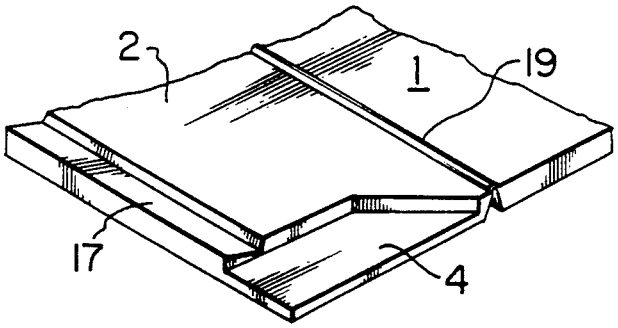
FIG. 3 illustrates a detailed isometric view of the flap of the unitary paint brush and bristle holder.

FIG. 3 illustrates an isometric detailed view of the corner of the flap 2, hinge line 19 and body 1 combination. The free end of the flap 2, at the edge away from the hinge line 19, has formed therein along its length a clip depression 17, which is adapted to receive the stainless steel reinforcing U clip 8 (see FIG. 1). The corner of the flap 2 is recessed to form depression 4, which is adapted to receive spring 5, when the spring 5 is rotated to a closed position whereby the flap 2 is pressed against the bristles (not shown).

Figure 4:
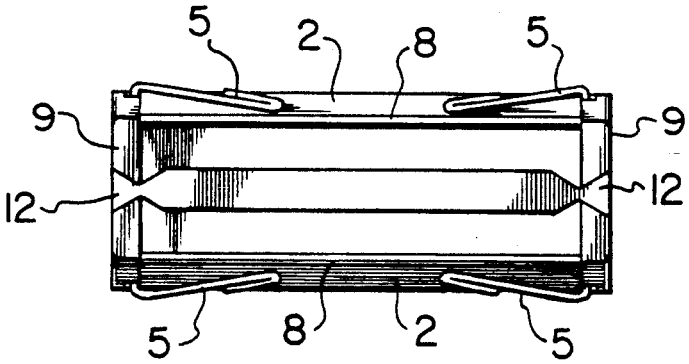
FIG. 4 shows an end view of the base of the unitary paint brush and bristle holder.

FIG. 4 illustrates an end view of the unitary paint brush and bristle holder, without the bristles. The pair of stainless steel reinforcing U clips 8 extend along each longitudinal side of the flaps 2. As seen in FIG. 4, the flaps and clips 8 are in a closed position, with the four rotatable springs 5 moved to respective closed positions. End flaps 9 extend along the edge of each narrow lateral side of the bristle holder. Located between the two flaps 2 and clips 8, at mid-point, and parallel therewith, is a removable mid-section 11. Mid-section 11 is formed to have at each end a pair of wedge-shaped ends 12, which fit within the wedge-shaped opening in the end of respective end flaps 9. While not shown, the bristles 6 are mounted in two groups in the spaces formed between mid-section 11 and the adjacent parallel flaps 2 and clips 8.

Figure 5:
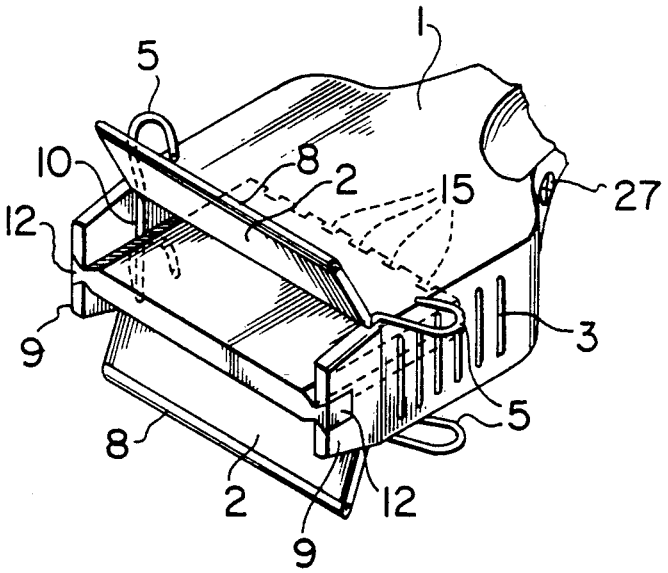
FIG. 5 illustrates an isometric view of the base of the unitary paint brush and bristle holder.

FIG. 5 illustrates an isometric view of the end of the unitary paint brush and bristle holder 1, before the bristles are installed in the two spaces formed between the pair of flaps 2, part of the body 1, and the mid-section 11. As seen in FIG. 5, the two springs 5 have been moved to respective open positions, and the pair of flaps 2 with U clips 8 are hinged away from the respective end flaps 9 along hinge line 19. Mid-section 11 can be seen mounted between end flaps 9, and held in place by respective wedges 12. Finger grips 3 are also shown on the one visible narrow lateral side of the body 1. In the position illustrated in FIG. 5, the unitary paint brush bristle and holder is adapted to receive the insertion of two bunches of bristles 6 (not shown) in the respective openings existing between the central mid-section 11 and the exterior adjacent flaps 2, and the interior of body 1, formed on either side of mid-section 11. Once the bristles are installed, the bristles are glued in place by injecting glue through heart valve 27 (see also FIG. 1). A corresponding heart valve 27 is located on the opposite narrow side of body 1, although it is not visible in FIG. 5. A series of openings 15 are formed in the edge of the mid-section 11 adjacent the body 1. These openings 15 permit glue to pass from one side of mid-section 11 to the other side of mid-section 11, thereby ensuring consistent and uniform gluing of the bristles in place in the interior of the body 1.

Figure 6:
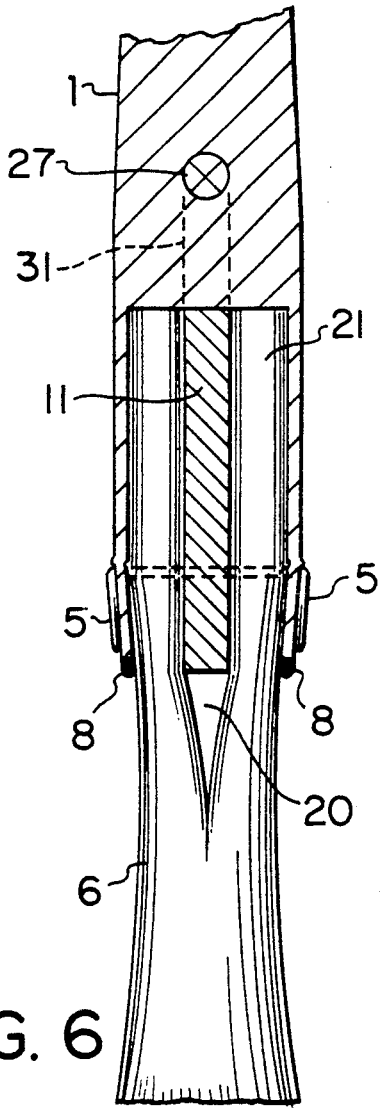
FIG. 6 illustrates a partial section side view of the unitary paint brush and bristle holder.

FIG. 6 illustrates a side partial section view of the unitary paint brush body and bristle holder, with the two groups of bristles 6 installed within the interior of the body 1, between the pair of flaps 2, and clips 8, and the central mid-section 11. The bristle base 21 is glued in place by injecting glue through heart valve 27, which communicates with bristle base 21 by interior channel 31. As seen in FIG. 6, the springs 5 are in a closed position whereby flaps 2, and the respective U clips 8, are pressed against the exterior sides of the two groups of bristles 6 to compress them tightly together against mid-section 11. FIG. 6 also illustrates the cavity 20, which is formed in the bristles 6 by the end of mid-section 11. This cavity 20 is useful for enabling the paint brush to hold more paint than would be the case if cavity 20 were absent. This reduces the frequency of dipping the brush in a paint can.

Figure 7:
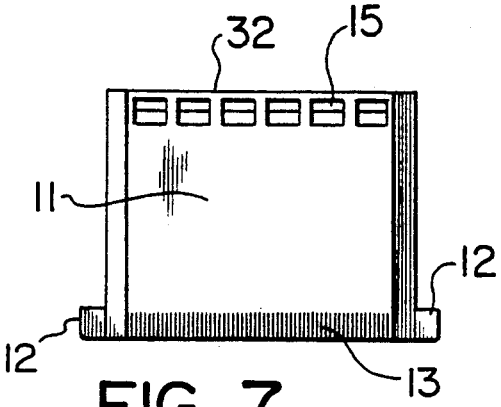
FIG. 7 illustrates a front view of the removable mid section of the unitary paint brush and bristle holder.

FIG. 7 illustrates a detailed front view of the construction of the mid-section 11. The mid-section is generally rectangular in construction, and planar. A pair of wedge inserts 12 are formed at the two bottom corners. These two wedges 12 fit respectively within the wedge openings which are formed in the two end flaps 9 of the body 1 (see FIG. 1). A series of striations 13 are formed along the edge of mid-section 11, between the pair of wedges 12. These striations 13 help hold the adjacent bristles 6 (not shown) and prevent the bristles from wiggling back and forth when the brush is being used. On the side of the mid-section 11 opposite the striations 13, there are formed a series of openings 15, which serve to permit glue, such as epoxy glue, to pass from one side to the other side of mid-section 11. A narrow bar 32 passes across the open edges of the openings 15. This bar 32 serves to grip the glue after it hardens, thereby deterring the removal of mid-section 11, once glue is in place. If bar 32 were not present, and the openings 15 were thus open-ended, it is possible that with use the mid-section 11 could be pulled away from the glue which holds the bristle base 21 in place within the interior of the paint brush body 1.

Figure 9:
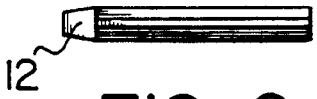
FIG. 9 illustrates a side view of the mid-section.
Figure 8:
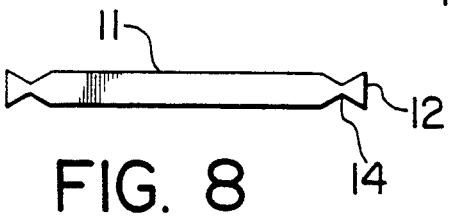
FIG. 8 illustrates an end view of the mid-section.

FIG. 8 illustrates an end view of the mid-section 11, and in particular, the construction of the pair of wedges 12 at each end. The locations where the pair of wedges 12 join with the main body of the mid-section 11 are narrow to correspond with the tapered shape of the wedge openings formed in end flaps 9. This construction prevents the pair of end flaps 9 from flaring away from mid-section 11, when pressure is applied to the paint brush bristles. FIG. 9 illustrates a detailed end view of the mid-section 11 and the wedge 12.

Figure 10:
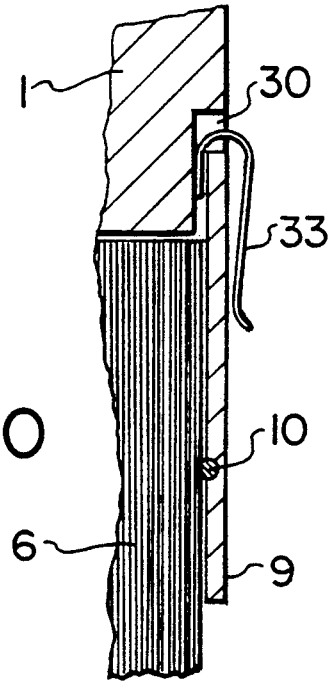
FIG. 10 illustrates a partial section side view of a paint brush with a hook.

FIG. 10 illustrates a front partial section view of a portion of the paint brush body 1 and end flap 9, equipped with a hook 33. This hook 33 is optional and fits in opening 30, formed in body 1 (see also FIG. 1). The hook 33 enables the paint brush to be conveniently hooked onto the edge of a paint can. Often, it is difficult to find a location to lay down a wet paint brush. Laying the paint brush along the edge of the top of a can sometimes causes an accident where the brush either falls into the interior of the can, or gets knocked off and falls onto the floor, thereby putting unwanted paint on the floor.

Figure 11:
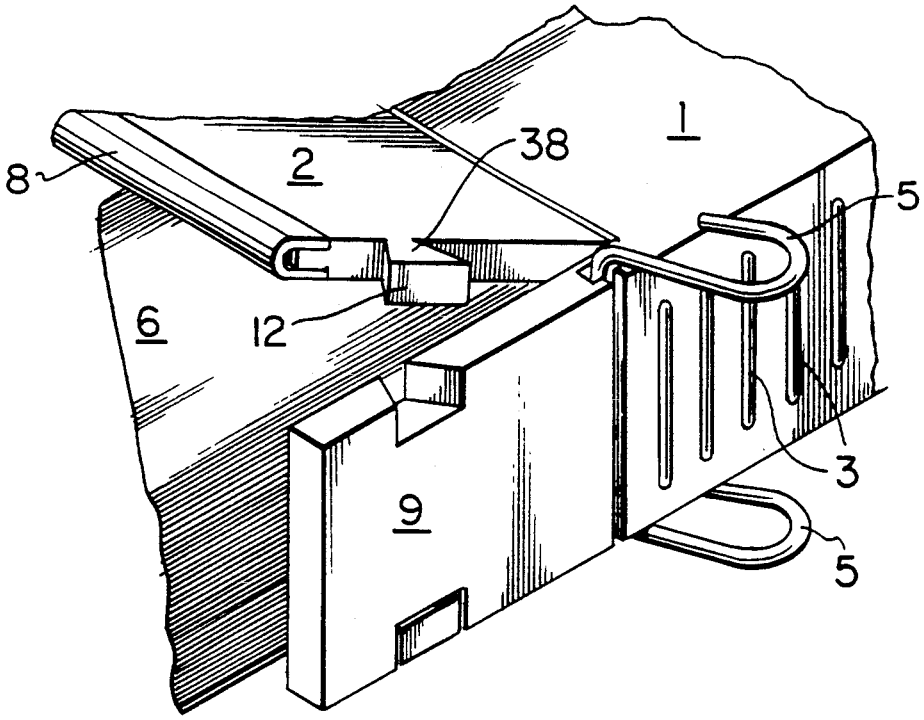
FIG. 11 illustrates an isometric view of a paint brush without a mid-section.

FIG. 11 illustrates an isometric view of an alternative embodiment of brush. The mid-section 11 is optional. It does not necessarily have to be present in the unitary paint brush and bristle holder. If the mid-section 11 is absent, wedges can be formed in the ends of the flaps 2, which are adapted to mate with corresponding wedge-shaped recesses in the sides of end flaps 9, thereby enabling the flaps 2 to unite with the end flaps 9, when the springs 5 are moved into place. This configuration is illustrated in FIG. 11.

A major advantage of the unitary paint brush is that it can be quickly and economically injection molded in one piece, thereby eliminating the need to have a separate ferrule, and a separate handle. The unitary brush is therefore more economical to produce in mass quantities.

Another major advantage is that when the pair of flaps 2 are forced against the bristles 6 by moving springs 5 into a closed position, the solid paint particles in the paint emulsion coating the bristles 6 are prevented from migrating along the bristles past the reinforcing U clip edges 8. While the liquid medium of the paint emulsion may migrate by capillary action along the bristles 8, and past the pair of flaps 2, the solids in the emulsion are effectively stopped at the point of pressure under the edge of the pair of U clips 8. A liquid solid separation therefore takes place in the region of each flap 2 and U clip 8. When it is time to clean the paint brush, the springs 5 are rotated into open positions, the pair of hinged flaps 2 are pivoted away from the bristles 8, and bristles which have not been coated with solid paint are exposed for cleaning with a paint solvent. The interrupted solids are openly exposed on the bristles 6, at an intermediate point, and are not accumulated against the base of the bristles. The solvent can be either a petroleum distillate, which is normally used for cleaning oil-based paint brushes, or water, which is used to remove water soluble latex-based paints.

Tests which have been conducted with a prototype indicate that the bristles 6 can be completely cleaned using only about 10 to 20 percent of the amount of solvent that is normally used to clean a conventional paint brush. Much of the solvent in a conventional case is consumed by endeavouring to clean away the collected and coagulated paint solids, which typically form and collect at the base of the bristles, where they joint the ferrule in a conventional paint brush. Another advantage of a unitary paint brush design, with hinged end flaps 2, is that the paint particles are prevented from contacting the junctions where the bristles meet the brush handle, or ferrule, where they tend to dry and stiffen. The dried paint causes flex points which force the bristles to bend at those points, eventually leading to breakage of the bristles.

Because there is no build-up of paint solids within the bristles 6, the region where the bristles 6 are set into the interior of the body 1 remains clear and flexible, and accordingly bristle flare and bristle wear are avoided or minimized. A longstanding problem with conventional paint brushes is that the performance of the paint brush is proportionately reduced with the build-up of clogged dry paint at the base regions of the bristles. This does not occur in the applicant's unitary paint brush construction because the flaps 2 can be moved away from the bristles 6 to expose the bristles for ready cleaning. It is only when the paint brush is being used that the flaps 2 are closed against the bristles 6 by moving springs 5 into a closed position.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paint brush comprising:

(a) a paint brush body and handle extending from one end of the body, the body having another end which is provided with an elogated cavity adapted for receiving a group of bristles, said cavity being defined by first and second opposed end walls and first and second sides extending therebetween;

(b) a pair of hinged members secured to a respective one of the first side and second side of the body, and projecting over the cavity, the hinged members securing the bristles when moved to a closed position, and releasing the bristles when moved to an open position;

(c) resilient movable securing means for securing the hinged members in the closed position and releasing the hinged members for movement to the second open position; and (d) a group of bristles secured within the cavity of the body, and between the pair of hinged members.

2. A paint brush as claimed in claim 1 wherein the pair of hinged members are elongated planar flaps, and are respectively hinged along the first side and second side of the body, adjacent the cavity.

3. A paint brush as claimed in claim 2 wherein the elongated planar flaps have edges, the edges having reinforcing clips secured thereto.

4. A paint brush as claimed in claim 3 wherein the movable securing means are springs which pivot relative to the pair of flaps, and when pivoted to a first position, close the flaps against the bristles, and when pivoted to a second open position, enable the flaps to be moved away from the bristles.

5. A paint brush as claimed in claim 4 wherein a removable bristle separator is located in the cavity between the pair of hinged members.

6. A paint brush as claimed in claim 2 wherein the planar flaps have connectors which enable the planar flaps to be connected with the end walls formed between the planar flaps, when the planar flaps are in the closed position.

7. A paint brush comprising:

(a) a paint brush body and a handle extending from one end of the body, the body having another end provided with an elongated cavity for receiving a group of bristles, said cavity being defined by first and second opposed end walls and first and second sides extending therebetween;

(b) a pair of elongated planar flaps hinged along a respective one of the first side and second side of the body, adjacent the cavity, and projecting over the cavity, the elongated planar flaps securing the bristles when moved to a closed position, and releasing the bristles when moved to an open position, the planar flaps having edges, the edges having reinforcing clips secured thereto;

(c) movable securing means for securing the elongated planar flaps in the closed position and releasing the planar flaps for movement to the open position; and (d) a group of bristles glued to fixedly attach the bristles to a bristle separator by injecting glue through an opening that penetrates through the brush body into the cavity.

8. A paint brush as claimed in claim 7 wherein the bristle separator is secured to said end walls between the respective planar flaps.

9. A paint brush as claimed in claim 8 wherein the bristle separator has a series of openings along an edge thereof, said openings being adapted to enable the glue to pass from a first side of the bristle separator to a second side of the bristle separator, and hold the separator in place within the cavity.

10. A paint brush as claimed in claim 9 wherein a hook is installed in the body of the paint brush, the hook being adapted to enable the paint brush to be hooked onto a paint can.

11. A paint brush as claimed in claim 10 wherein the movable securing means are metal springs.

12. A paint brush comprising:

(a) a paint brush body and handle extending from one end of the body, the body having another end which is provided with an elongated cavity adapted for receiving a group of bristles, said cavity being defined by first and second opposed end walls and first and second sides extending therebetween;

(b) a pair of hinged members secured to a respective one of the first side and second side of the body, and projecting over the cavity, the hinged members secured the bristles when moved to a closed position, and releasing the bristles when moved to an open position;

(c) securing means including at least one U-shaped spring for resiliently securing the hinged members in the closed position and releasing the hinged members for movement to the open position; and (d) a group of bristles secured within the cavity of the body, and between the pair of hinged members.

13. A paint brush as claimed in claim 12 wherein the securing means includes two U-shaped springs pivotally attached to the end walls.

14. A paint brush as claimed in claim 13 wherein the springs are disposed within grooves provided in the end walls.

15. A paint brush as claimed in claim 13 wherein a bristle separator is disposed within the cavity.

16. A paint brush as claimed in claim 15 wherein the bristle separator is attached to the end walls.

17. A paint brush as claimed in claim 16 wherein the bristle separator is attached to openings formed within the end walls.

18. A paint brush as claimed in claim 12 wherein the at least one spring has a hook shaped end for engaging the hinged members.

19. A paint brush as claimed in claim 12 wherein the body defines an opening that penetrates through the brush body into the cavity.

* * * * *